US006511014B1

(12) United States Patent
Ehmann et al.

(10) Patent No.: US 6,511,014 B1
(45) Date of Patent: Jan. 28, 2003

(54) SPOOLING DEVICE WITH A SUPPORT

(75) Inventors: Wolfgang Ehmann, Linkenheim-Hochstetten (DE); Dietmar Giel, Karlsruhe (DE)

(73) Assignee: Zentes Unitex Textile Machinery GmbH & Co. KG (DE)

( * ) Notice: Subject to any disclaimer, the term of this patent is extended or adjusted under 35 U.S.C. 154(b) by 0 days.

(21) Appl. No.: 09/674,579

(22) PCT Filed: Apr. 28, 1999

(86) PCT No.: PCT/EP99/02861

§ 371 (c)(1),
(2), (4) Date: Oct. 31, 2000

(87) PCT Pub. No.: WO99/57053

PCT Pub. Date: Nov. 11, 1999

(30) Foreign Application Priority Data

May 2, 1998 (DE) ..... 198 19 749

(51) Int. Cl.[7] ..... B65H 54/22

(52) U.S. Cl. ..... 242/474.5; 242/474.8; 242/596.5

(58) Field of Search ..... 242/596.5, 474.5, 242/474.6, 474.8

(56) References Cited

U.S. PATENT DOCUMENTS

| | | | | | |
|---|---|---|---|---|---|
| 2,759,679 | A | * | 8/1956 | Torregrossa et al. | 242/596.5 X |
| 4,438,554 | A | * | 3/1984 | Sciola et al. | 242/596.5 X |
| 4,676,448 | A | * | 6/1987 | Kofler | 242/596.5 X |
| 4,801,109 | A | * | 1/1989 | Hatakeyama et al. | 242/596.5 X |
| 5,234,173 | A | * | 8/1993 | Nishikawa et al. | 242/474.5 |
| 6,053,449 | A | * | 4/2000 | Wolf et al. | 242/474.5 |
| 6,193,185 | B1 | * | 2/2001 | Kim | 242/474.8 X |

FOREIGN PATENT DOCUMENTS

| | | | |
|---|---|---|---|
| DE | 41 33 232 A | * | 4/1992 |
| DE | 195 34 914 A | * | 5/1996 |

* cited by examiner

*Primary Examiner*—Michael R. Mansen
(74) *Attorney, Agent, or Firm*—McGlew and Tuttle, P.C.

(57) ABSTRACT

The spooling device is provided for continuously incoming threads. The device has at least one bobbin holder for receiving several bobbin tubes. The bobbin holder is fixed at one end and has an opposite loading end. The bobbin holder is connected to a bobbin positioning device which supports the bobbin first end. The bobbin positioning device moves the bobbin holder between a first spooling position and a second removal position. A second end support is provided which engages the free end of the bobbin holder only in the first spooling position and does not block the bobbin holder from removal in the second removal position.

25 Claims, 4 Drawing Sheets

SPOOLING DEVICE WITH A SUPPORT

FIELD OF THE INVENTION

The invention relates to a spooling or bobbining device for continuously incoming threads and the like with at least one bobbin holder for receiving several bobbin tubes or cases, which can be engaged over or removed from a free end of the bobbin holder, whose other end is fixed.

BACKGROUND OF THE INVENTION

Spooling devices are known per se and are used for spooling yarns, threads, wire, etc.

As a result of ever increasing rationalization the aim is to spool as many bobbins as possible in the shortest possible time. For example DE 195 20 28 and DE 39 09 106 A1 disclose a bobbin revolving means, which carries two bobbin holders, whereof one which is located in the operating position is wound with threads and the like and the second which is located in the inoperative position, where the wound bobbin tubes can be removed and replaced by new ones.

One possibility for increasing the capacity of such a spooling device is to increase the number of the bobbin tubes located on the bobbin holder and which can be simultaneously wound. The limiting factor in the prior art in this connection is constituted by the bobbin holder which, on exceeding a given length, under the force acting during the winding of the threads tends to sag as a result of an only one-sided mounting, so that the driving forces applied by friction for the rotation of the bobbins close to the free end of the bobbin holder are no longer sufficient to ensure a completely satisfactory operation.

SUMMARY AND OBJECTS OF THE INVENTION

The problem of the present invention is to propose a spooling device, in which the number of bobbin tubes to be placed on the bobbin holder can be significantly increased without the aforementioned disadvantages occurring.

In the case of the aforementioned spooling device, this problem is solved by the present invention in that the spooling device has a support mechanism in engagement with the free end of the at least one bobbin holder in the operating position.

As a result of the additional support mechanism at the free end of the bobbin holder, there is consequently a two-sided supporting thereof in operation.

The invention can be used in the case of different spooling devices, such as those with only one bobbin holder or also those having several bobbin holders. The invention can in particular be used in the case of a spooling device with a bobbin revolving means carrying two bobbin holders, which in this way are rotatable by means of the bobbin revolving means between an operating position and a setting up or loading position. However, the use of the invention is not restricted to such a spooling device.

Advantageously the support mechanism has a member for engaging in the free end of the bobbin holder. This ensures that the positioning of the individual bobbins on the bobbin holder is not impaired by the support mechanism and the support mechanism member for engaging in the free end of the bobbin holder is advantageously a mandrel.

According to a preferred development there is a non-positive engagement of the support mechanism. This ensures the engagement of the support mechanism in the bobbin holder, because there is consequently no relative movement between the two members which could impair the support function.

For the secure, non-positive reception of the support mechanism the bobbin holder has at its free end a corresponding bore.

Advantageously the support mechanism is constructed in such a way that the member in engagement with the free end of the bobbin holder is mounted in rotary manner therein, so that the member engaging in the free end of the bobbin holder can rotate therewith, whereas the support mechanism remains stationary.

Preferably said means are constituted by ball bearings.

According to an advantageous further development the member for engagement in the bobbin holder is substantially aligned therewith. This offers the possibility of a direct introduction of the member into the bobbin holder bore without impairing the movement of the bobbin revolving means.

In an alternative construction the free end of the bobbin holder has a mounting support rotatable relative thereto for the member engageable therewith and in particular the mounting support for the support mechanism member engageable therewith is mounted by means of a ball bearing. According to a further development the support mechanism member engageable with the bobbin holder is placed in non-rotary manner on the same. As a result the member carried by the support mechanism and engaging in the bobbin holder for supporting the same no longer rotates together therewith, so that it does not have to be brought in precisely aligned manner in engagement with the bobbin holder axis and no true running problems arise, because the engageable member, particularly a mandrel, does not rotate with the bobbin holder and instead remains stationary.

According to a preferred development the support mechanism has a sliding bush for receiving the member for engagement in the bobbin holder and which permits a sliding of the member in an aligned direction with respect to the bobbin holder. As a result of the sliding bush the member, together with the ball bearing for its rotary mounting, can be brought into or moved out of its operating position with the bobbin holder.

Advantageously the sliding bush can be slid along the longitudinal axis of the bobbin holder, so that the support mechanism member can be moved out of its operating position in such a way that the bobbin holder can be rotated by the bobbin revolving means from the supported operating position into the unsupported inoperative position for removing the wound tubes.

Preferably the support mechanism has means for sliding the sliding bush and consequently also the member mounted in rotary manner in said sliding bush.

Advantageously the support mechanism is placed in fixed manner on the spooling device, so that it can always be brought into engagement with the bobbin holder in the operating position, whereas with the bobbin holder in the inoperative position by means of its free end the wound bobbin tubes can be removed and new bobbin tubes fitted.

BRIEF DESCRIPTION OF THE DRAWINGS

An embodiment of the spooling device according to the invention is described in greater detail hereinafter relative to the attached drawings, wherein show.

DESCRIPTION OF THE PREFERRED EMBODIMENT

Figure 1:
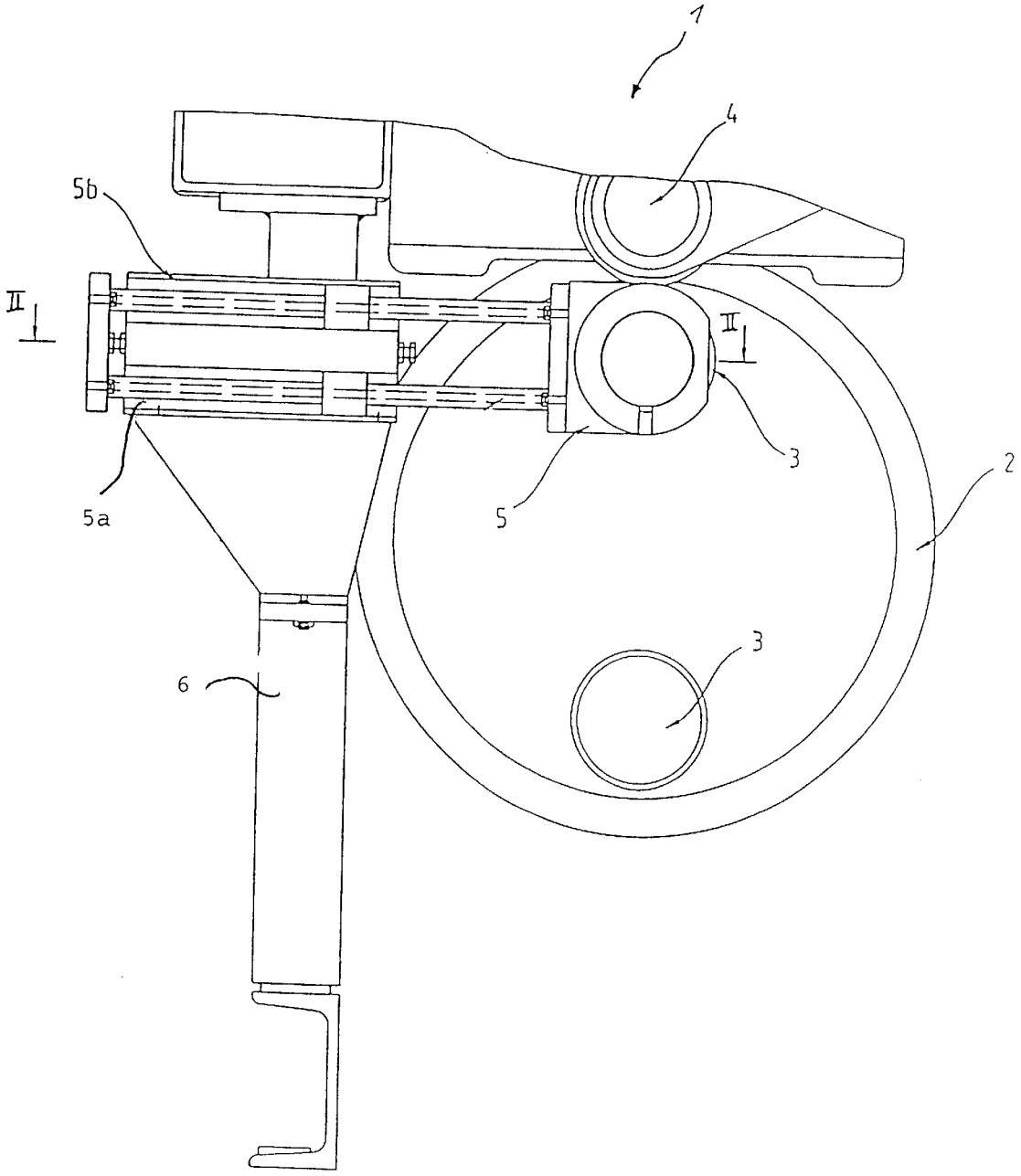
FIG. 1 In a partly broken away representation a front view of the spooling device.

FIG. 1 shows a spooling or bobbining device 1 with a bobbin revolving means 2, on which two bobbin holders 3, 3' are positioned in such a way that their longitudinal axes extend perpendicular to the disk face of the bobbin revolving means 2, which is provided with a not shown drive motor. By means of the drive motor the bobbin revolving means can be rotated about its central axis and the bobbin holders 3, 3' can be alternately rotated therewith in the operating position 3 or inoperative position 3'. To the bobbin holder 3 located in the operating position or the bobbin tubes (not shown) located on the bobbin holder is supplied by means of a not shown supply device the material, in the form of threads, to be wound. Winding takes place onto the tubes located on the bobbin holder 3 and they are driven by means of a contact roller 4 pressed against the tubes. After ending the spooling process the bobbin holder is brought into the inoperative position 3', where the wound tubes are removed and replaced by new tubes. The operating steps of spooling onto one bobbin holder during the removal of the bobbin tubes and reloading on the second bobbin holder are performed simultaneously. A support mechanism 5 is located on the end, opposite to the bobbin revolving means 2, of the bobbin holder 3 in the operating position. A carrying device 5*a* carrying the support mechanism 5 is placed in fixed manner on the carrying profile 6 of the spooling device 1, so that the support mechanism for operation is located on the end of the particular bobbin holder 3 in the operating position opposite to the bobbin revolving means. The carrying device 5*a* has piston-cylinder arrangements 5*b*, by means of which the support mechanism 5 can be moved away from the bobbin holder 3 parallel to the plane of the disk face of the bobbin revolving means 2.

Figure 2:
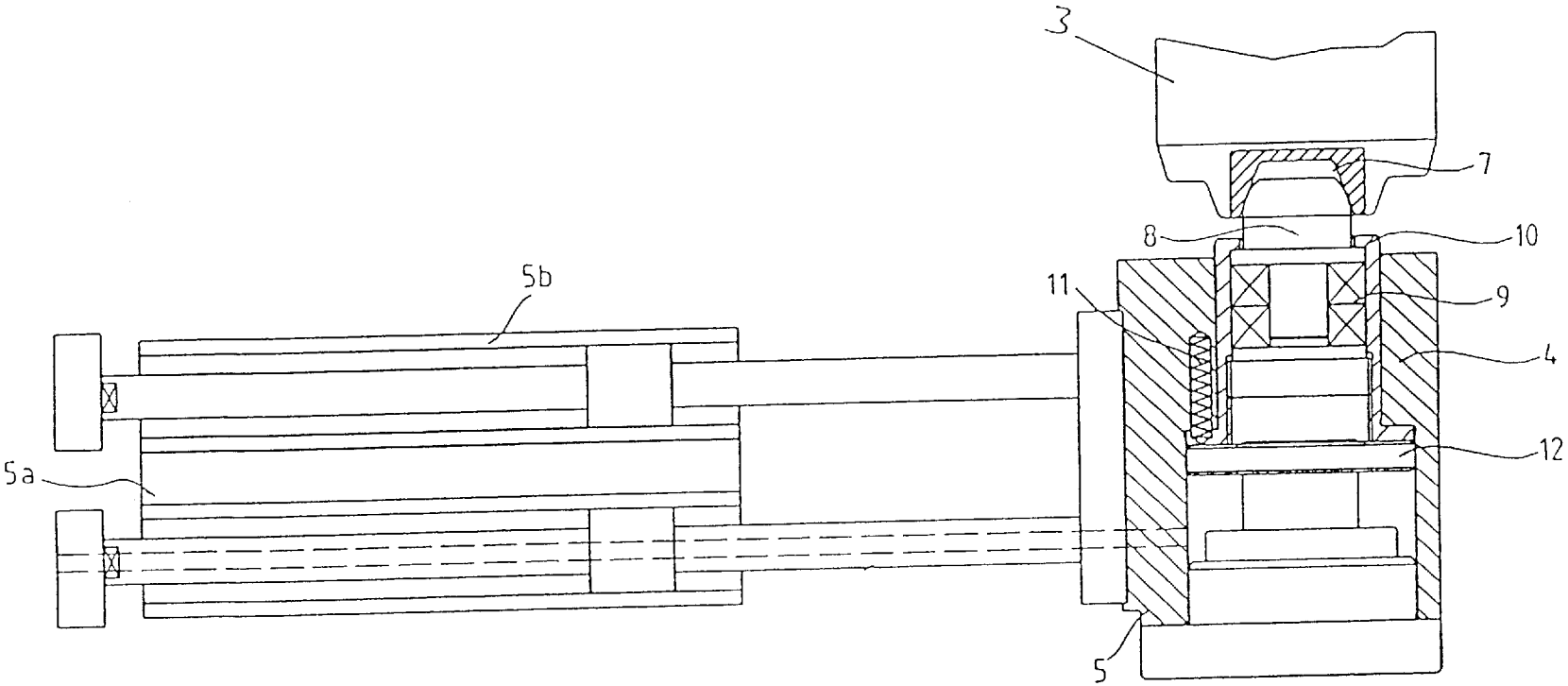
FIG. 2 A longitudinal section along line II—II in FIG. 1.

FIG. 2 shows the end of the bobbin holder 3 facing the support mechanism 5 and said holder has at its end a bore 7 for receiving a mandrel 8. The mandrel 8 of the support mechanism 5 engages in the recess of the bobbin holder 3 in the operating position and consequently prevents an excessive bending or even breaking of the bobbin holder 3 when the latter is under the tensile load of the material to be wound supplied from the supply device during the spooling process. This is in particular necessary if the bobbin holder length assumes values of 1 m or more as a result of capacity increases, particularly during the processing of bobbin tube numbers exceeding the hitherto conventionally assumed eight such holders.

In the represented embodiment the mandrel 8 engages positively in the recess 7 of the bobbin holder 3. The joint rotation of the mandrel 8 with the rotating bobbin holder 3 is made possible by ball bearings 9 by means of which the mandrel 8 is mounted in the tube 4 of the support mechanism 5. After the ending of the spooling process the bobbin holder 3 is rotated from the operating position into the inoperative position by means of the bobbin revolving means 2. To permit the rotary movement of the bobbin holder 3 the mandrel 8 is released from the recess 7 of the bobbin holder 3. Release takes place by means of a sliding bush 10. The mandrel 8 and its ball bearing arrangement 9 are fixed in said sliding bush 10 displaceable with respect to the tube 4 of the support mechanism 5. The sliding bush 10 and with it the rotatably mounted mandrel 8 are moved in the direction of the bobbin revolving means 2 counter to the action of the spring 11 by a sliding mechanism 12*a* and the mandrel 8 is consequently brought into the working position with the bobbin holder 3 in the operating position.

Figure 3:
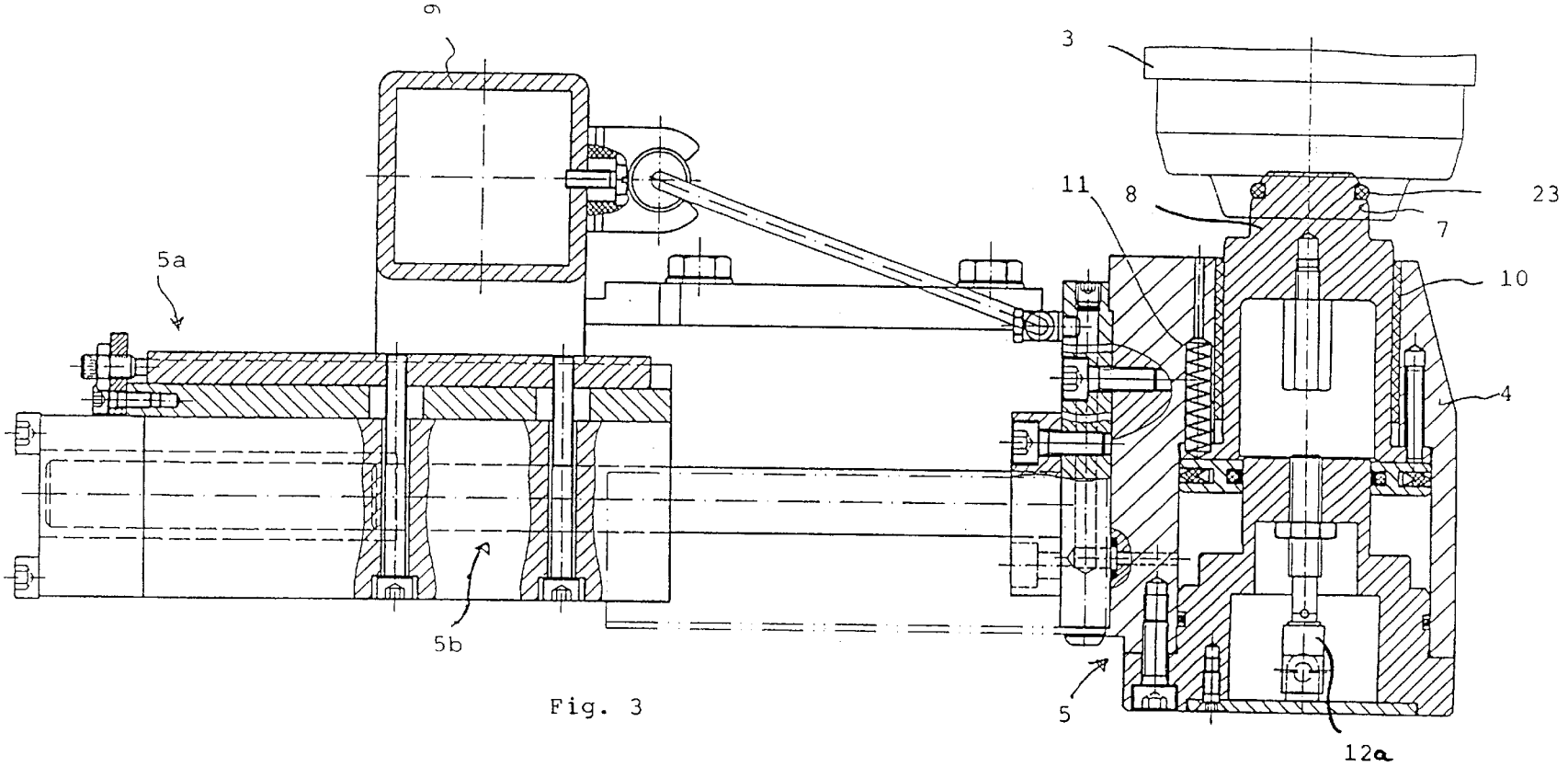
FIG. 3 A longitudinal section similar to that of FIG. 2 for an alternative construction of the mounting support for the free end of the bobbin holder.
Figure 4:
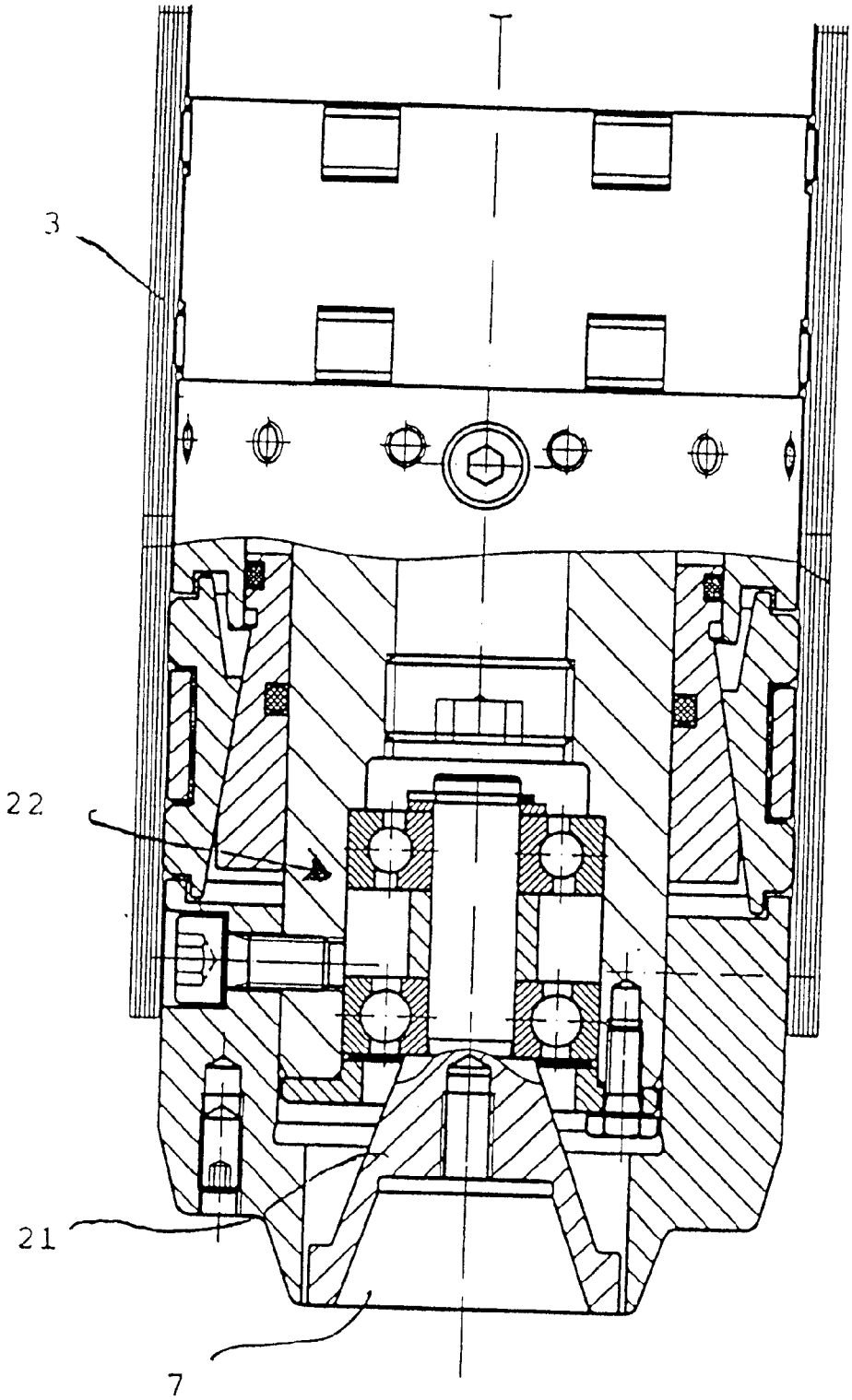
FIG. 4 A section through the end of the bobbin holder according to FIG. 3.

FIGS. 3 and 4 show an alternative construction for the support of the free end of the bobbin holder 3. Once again there is a support mechanism 5, which is mounted on a carrying profile 6 of the spooling device 1 (FIG. 1) by means of a carrying device 5*a* provided with a piston-cylinder arrangement 5*b*. The member engageable with the bobbin holder is once again constituted by a mandrel 8 which, in the support mechanism 5, can be slid counter to the action of a spring 11 in a sliding bush 10 by means of the sliding mechanism 12*a* (e.g. a arrangement), without a pivot bearing being provided for the mandrel 8.

The mandrel 8 can be locked to the bobbin holder 3 by means of a locking mechanism 23, e.g. in the form of an open spring ring and consequently positive engagement takes place. For the removal of the mandrel the spring 11, whose tension exceeds the holding power of the ring 23, forces the mandrel out of the ring.

Since, as stated, the mandrel 8 is not ball bearing-mounted, but instead the bobbin holder 3 rotates, according to the development of FIGS. 3 and 4 only on the bobbin holder 3 is there a rotary mounting support 21 with a recess 7 for receiving the mandrel 8. The mounting support 21 is mounted in rotary manner in the bobbin holder 3 by means of a ball bearing 22.

What is claimed is:

1. A spooling device for continuously incoming threads, the device comprising:

a bobbin holder;

bobbin sleeves, said bobbin holder for receiving several said bobbin sleeves, said bobbin sleeves being engaged over and removed with respect to a free end of said bobbin holder, said bobbin holder having another end that is fixed; and a support mechanism with a stationarily disposed support position at a bobbin winding position and in engagement with the free end of said bobbin holder only with the bobbin holder in the bobbin winding position.

2. A device according to claim 1, wherein the support mechanism has a member for engaging in the free end of said bobbin holder.

3. A device according to claim 2, wherein said member of said support mechanism for engaging in the free end of the bobbin holder is a mandrel.

4. A device according to claim 3, wherein said mandrel engages said bobbin holder in a nonpositive manner.

5. A device according to claim 3, wherein said member is held locked to said bobbin holder in an engaged position.

6. A device according to claim 2, wherein said member of said support mechanism engages said bobbin holder in a nonpositive matter.

7. A device according to claim 2, wherein said member is held is locked to said bobbin holder in an engaged position.

8. A device according to claim 2, wherein at its free end the bobbin holder has a recess for receiving the support mechanism member in engagement therewith.

9. A device according to claim 2, wherein the support mechanism has means for the rotary mounting of the member in engagement with the free end of the bobbin holder.

10. A device according to claim 9, wherein said means are ball bearings.

11. A device according to claim 2, wherein the free end of the bobbin holder has a mounting support, rotatable relative thereto, for the member engageable therewith.

12. A device according to claim 11, wherein the mounting support for the member of the support mechanism which can be engaged therewith is mounted by means of a ball bearing.

13. A device according to claim 12, wherein the member of the support mechanism which can be engaged with the bobbin holder is positioned in non-rotary manner thereon.

14. A device according to claim 11, wherein the member of the support mechanism which can be engaged with the bobbin holder is positioned in non-rotary manner thereon.

15. A device according to claim 2, wherein the member for engagement in the bobbin holder is substantially aligned with the latter.

16. A device according to claim 2, wherein the support mechanism has a sliding bush receiving the member for engagement in the bobbin holder.

17. A device according to claim 16, wherein the sliding bush is mounted to slide along a longitudinal axis of the bobbin holder.

18. A device according to claim 17, wherein the support mechanism has means for sliding the sliding bush.

19. A device according to claim 16, wherein the support mechanism has means for sliding the sliding bush.

20. A device according to claim 16, wherein the sliding bush is slideable along the longitudinal axis of the bobbin.

21. A device according to claim 20, wherein the support mechanism has means for sliding the sliding bush.

22. A device according to claim 1, wherein the support mechanism is fixed on the spooling device.

23. A spooling device for continuously incoming threads, the device comprising:

a fit bobbin holder;

a second bobbin holder;

a bobbin positioning device for supporting said first bobbin holder and said second bobbin holder and respectively moving said first bobbin holder and said second bobbin holder between a winding position and a removal position;

bobbin sleeves, each of said first bobbin holder and said second bobbin holder for respectively receiving several said bobbin sleeves, said bobbin sleeves being engaged over and removed with respect to a free end of said respective first bobbin holder and second bobbin holder, each of said first bobbin holder and second bobbin holder respectively having another end that is fixed to said bobbin positioning device; and a support mechanism having a stationary disposed bobbin holder support position corresponding to the winding position with the support mechanism in engagement with the free end of only one of said first bobbin holder and second bobbin holder to only support the free end of said first bobbin holder and second bobbin holder in the winding position.

24. A device according to claim 23, wherein the support mechanism has axial movement means for axially moving a bobbin holder engaging portion of said support mechanism between said support position for engagement with the bobbin holder and a position spaced away from said support position.

25. A spooling device for continuously incoming threads, the device comprising:

a bobbin holder supported for movement between an winding position and a loading position spaced from said winding position, said bobbin holder having a supported end and having a free end;

a bobbin sleeves for engagement over and removal from said free end of said bobbin holder; and support mechanism having a stationary disposed support position corresponding to a bobbin holder winding position and engageable with sad free end of said bobbin holder only with said bobbin holder in said bobbin holder winding position, said free end of said bobbin holder being free of said support mechanism in said loading position.

* * * * *